United States Patent [19]

Valsecchi et al.

[11] Patent Number: 4,683,620

[45] Date of Patent: Aug. 4, 1987

[54] SAFETY CLOSURE DEVICE PARTICULARLY FOR SKI BOOTS

[76] Inventors: Carlo Valsecchi, Via Cipollina, 3; Franco Piatti, Via Nazionale, 43; Giuseppe B. Bazzi, Via Campione, all of Colico, Italy

[21] Appl. No.: 661,484

[22] Filed: Oct. 16, 1984

[30] Foreign Application Priority Data

May 8, 1984 [IT] Italy ..... 9513/84[U]

[51] Int. Cl.[4] ..... A43C 11/14

[52] U.S. Cl. ..... 24/71 SK; 24/68 SK; 24/585

[58] Field of Search ..... 36/50; 24/68 R, 68 SK, 24/69 R, 69 SK, 70 R, 70 SK, 71 R, 71 SK, 270–273, 170, 585, 504, 506, 71 J

[56] References Cited

U.S. PATENT DOCUMENTS

| | | | |
|---|---|---|---|
| 768,767 | 8/1904 | Mensor et al. | 24/504 |
| 2,888,729 | 6/1959 | Lettern et al. | 24/585 |
| 3,258,820 | 7/1966 | Steinberg | 24/70 SK |
| 3,561,067 | 2/1971 | Baso | 24/70 SK |
| 3,686,715 | 8/1972 | Brodnicki | 24/170 X |
| 4,115,905 | 9/1978 | Seidel | 24/70 SK X |
| 4,229,862 | 10/1980 | Kubelka | 24/68 SK |
| 4,395,801 | 8/1983 | Gabrielli | 36/50 X |

FOREIGN PATENT DOCUMENTS

| | | | |
|---|---|---|---|
| 70273 | 1/1983 | European Pat. Off. | 24/68 SK |
| 1330828 | 5/1963 | France | 24/71 SK |
| 595070 | 1/1978 | Switzerland | 24/68 SK |
| 4054 | of 1913 | United Kingdom | 24/504 |

*Primary Examiner*—Kenneth J. Dorner
*Assistant Examiner*—James R. Brittain
*Attorney, Agent, or Firm*—Guido Modiano; Albert Josif

[57] ABSTRACT

This safety closure particularly for ski boots comprises a closure lever associated with one of the flaps to be joined and connected to a link element. Coupleable to the link element is an opening element associated with the other of the flaps to be joined. Also provided is a locking lever adapted to prevent release of the closure lever as the link element is placed under tension, thereby the closure device has two separate members, the one for closing the device and the other for opening it.

3 Claims, 5 Drawing Figures

SAFETY CLOSURE DEVICE PARTICULARLY FOR SKI BOOTS

BACKGROUND OF THE INVENTION

This invention relates to a safety closure device particularly for ski boots.

As is known, ski boots are generally closed by means of a lever which is pivoted at one of its ends to a support connected to one of the flaps to be joined and having, at the other end thereof, a grip portion for operating the lever.

In general, connected to a middle portion of the lever is a link element, configured as a ring or strap, which engages with a hook, dog, or the like element attached to the other of the flaps to be joined.

With this lever type, the closure force is proportional to the reaction force on the intermediate pin whereat the link element is connected.

Furthermore, with levers of this kind, a clearance must be left between the operating end whereto the action of one hand is applied and the boot surface, to permit for the insertion of the hand fingers in order to lift the lever into the released or open position.

The need for keeping the lever end away from the boot represents a disadvantage in that it may get caught accidentally in some obstructions which, besides damaging the lever, may generate sufficient force to lead to undesired release and consequent opening of the lever.

It should be further added to the foregoing that, while during the closing or fastening operation the required force can be conveniently applied with the hand's palm, during the opening or releasing operation, the force can only be applied through the hand's fingers, which are inserted under the lever to pull it out, and since the effort to be expended for opening is related to the effort applied for closing, in many cases the lever is difficult to open.

In an attempt at obviating this disadvantage, it is current practice in the industry to provide specially long levers, which pose, however, space problems and make location of the lever on the boot a difficult task, with attendant increased manufacturing cost owing to the larger amount of material to be used.

SUMMARY OF THE INVENTION

It is an object of this invention, therefore, to obviate such prior disadvantages by providing a safety closure device particularly for ski boots, wherein the effort expended during the opening stage can be totally unrelated to the effort expended during the closing stage, and the closure levers may be held close against the boot or even set in pockets or patterns on the boot, thereby the levers are not liable to be incidentally opened owing to their free ends standing no longer proud.

It is a further object of the invention to provide a closure device, wherein the dimensions of the levers are significantly small, without jeopardizing the closure device ease of operation.

Another object of this invention is to provide a safety closure device which can successfully resist incidental release, thus contributing increased safety of operation, while being simpler to use.

A not unimportant object of this invention is to provide a closure device which can be formed from constructionally simple and easy-to-assemble elements, and can be competitive from the merely economical standpoint.

These and other objects, such as will be apparent hereinafter, are achieved by a safety closure device particularly for ski boots, characterized in that it comprises a closure lever associated with one of the flaps to be joined and connected to a link element, an opening element associated with the other of the flaps to be joined and matching said link element, and a locking means to prevent opening of said closure lever with said link element under tension.

BRIEF DESCRIPTION OF THE DRAWINGS

Further features and advantages will be more clearlly understood from the following description of a preferred, but not exclusive, embodiment of a safety closure device particularly for ski boots, with reference to the accompanying illustrative drawings, where.

DESCRIPTION OF THE PREFERRED EMBODIMENTS

Figure 1:
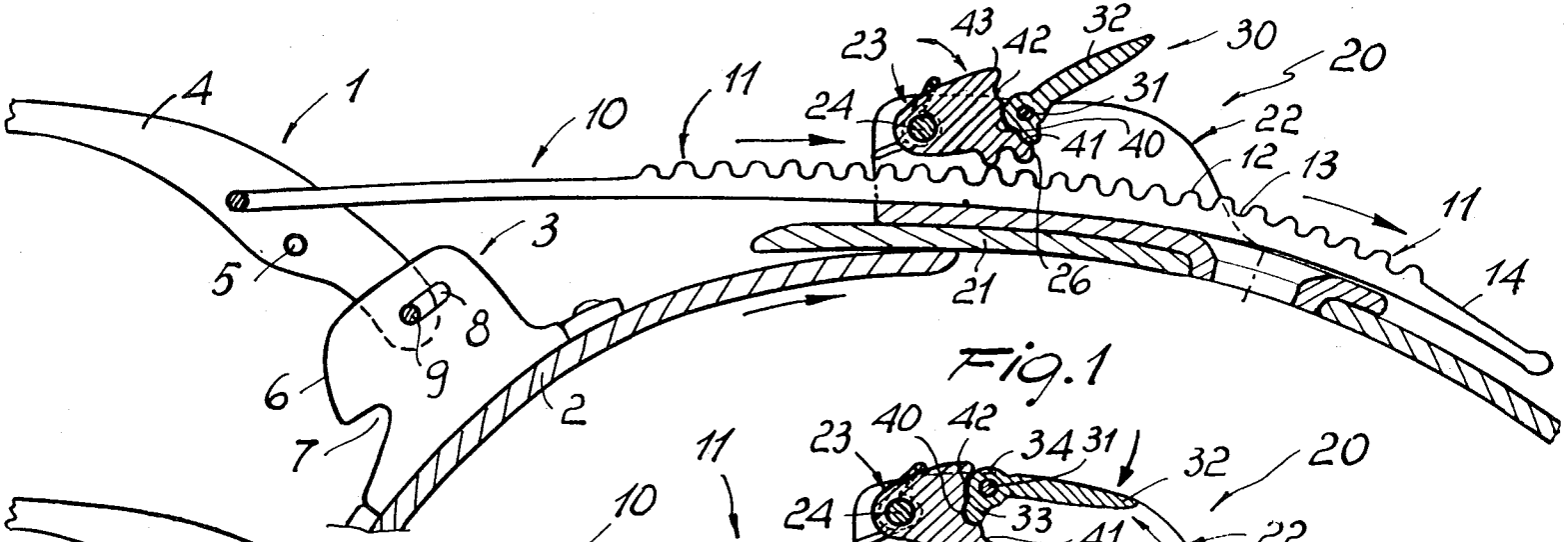
FIG. 1 shows this device with the closure lever in an intermediate open position, during the stage of adjustment of the working length of the link element.

With reference to the drawing views, this safety closure device particularly for ski boots, according to the invention, comprises a lever actuated tensioning mechanism including a closure lever, designated with the reference numeral 1, which is associated with one of the flaps to be joined, as indicated at 2.

The closure lever 1 is connected at a first ends to a shaped base 3 which is attached to the flap 2, while the other lever end, indicated at 4, defines an operating or actuating lug.

As usual, the base 3 has a U-like configuration in cross-section with two wings between which is arranged the first end of the lever 1. A lever actuated link element, overall designated with reference number 10, is pivotally connected to the lever 1 at a middle portion of the latter, included between the operating end 4 and shaped base 3, and is advantageously embodied as a serrated strap to be described hereinafter.

Coupleable to the serrated strap is an openable clamping mechanism, overall designated with the reference numeral 20, which is attached to the other of the flaps to be joined, indicated at 21.

More particularly, provided on the closure lever 1 is a locking means intended to prevent release of said closure lever 1 as the link element 10 is put under tension, i.e. is in the process of closing the boot or the like.

Said locking means comprises two pegs 5 (only one peg 5 being visible in the drawing) which project laterally from both sides of the lever 1 and engage with shaped portions 6 defined on the wings of the shaped base 3.

The pegs 5 engage by contact with the shaped portions 6 during the closing stage and arranged themselves into recesses 7 located at the lower portion of the wings of the shaped base 3.

To allow for the engagement of the pegs 5 with the recesses 7 formed in the wings of the base 3, the lever 1 is pivoted to the shaped base 3 such as to permit translation of the pivot point; more specifically, provided on the wings of the shaped base 3 are elongate slots 8 wherein the pivot pin 9 of the lever 1 can be pivotally and slidably engaged.

As visible in the drawing the slot 8 has a longitudinal extension in a direction towards the zone of said openable clamping mechanism 20. Moreover the distance of the recess or locking seat 7 from the flap 2 is smaller than the distance of slot 8 form the flap 2. As visible in FIG. 1 in the opening position of lever 1, the pivot pin 9 abuts against the end of the slot 8 furthest from the openable clamping mechanism 20.

Figures 3, 4, 5:
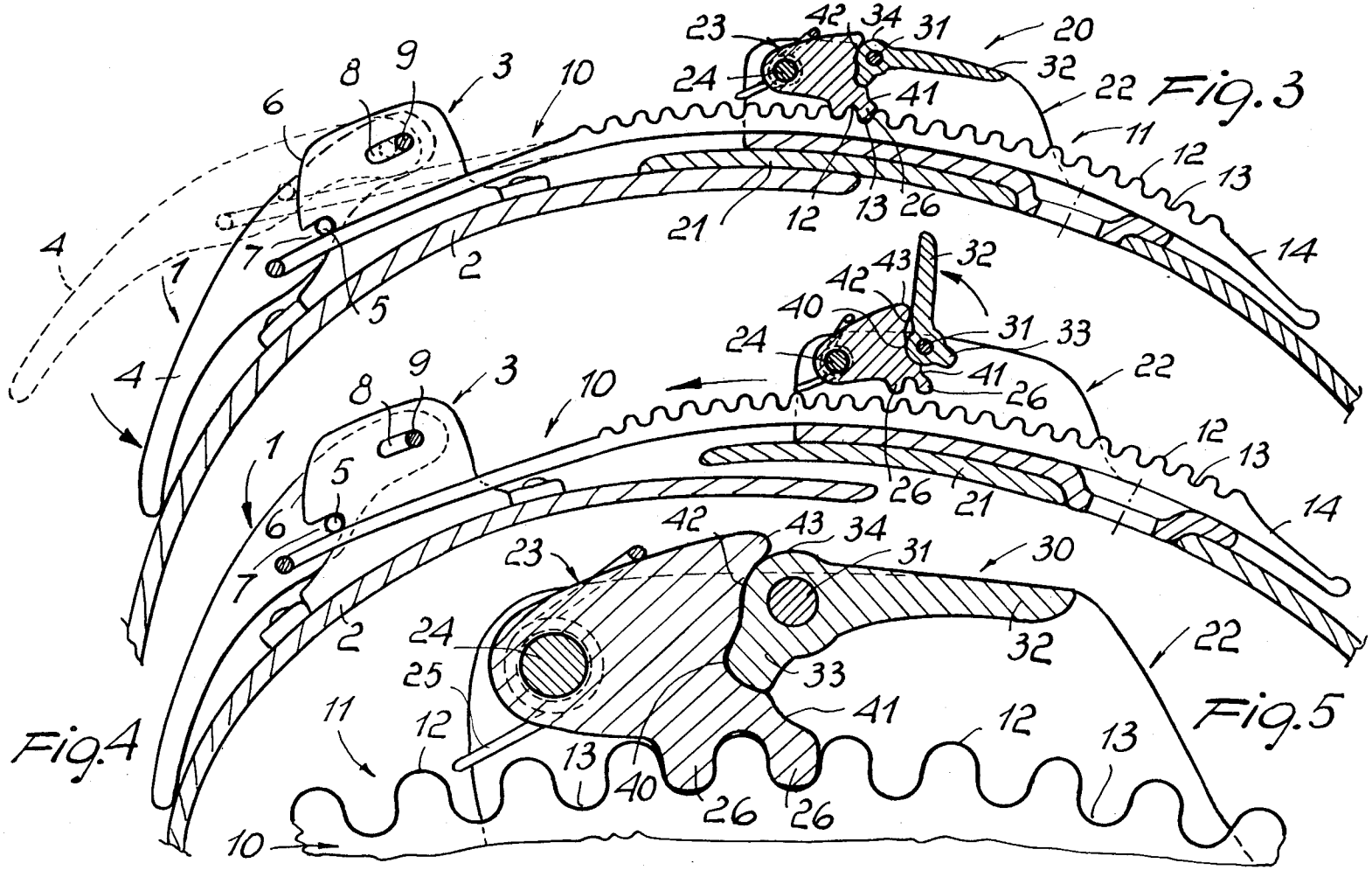
FIG. 3 shows the closure device in the closed position thereof.
FIG. 4 depicts the closure device in the final opening stage, through operation of the opening element.
FIG. 5 is an enlarged scale sectional view of the opening element.

During the closing stage of the device, acting on the lever 1 as shown by the arrow in FIG. 3, the pull exerted to close the boot by the link element causes, during the initial stage of rotation of the lever,the pegs 5 to engage with the shaped portions 6, whereafter, on reaching the recesses 7,the pegs are inserted into the recesses, with consequent movement of the pivot pin of the lever 1 into the slot 8 towards the end of the slot 8 nearest to the openable clamping mechanism 20, thereby the lever 1 cannot be turned open as long as the tension on the link element 10 is maintained.

As usual for levers of this type, the pull exerted by link 10 on the lever after closure of the device is applied to a point below the area of pivotal connection of the lever (as viewed in the drawing), thereby a component is created which tends to hold the lever in the closed position against the boot.

In this embodiment, the operating or actuating end of the lever 1 is shaped to adhere close against the boot surface, and possibly fit into recesses or pockets formed in the boot itself.

An important aspect of the invention is that this closure device is constructed to provide closure of the closure device by means of one lever, namely the lever 1, whereas for opening the closure device, another element is operated, i.e. the opening element 20, which has in practice the function of enabling disengagement of the link element such as to remove the tension acting thereon.

In particular, it should be stressed that by providing a release action which is no longer performed by means of a conventional lever, the opening element can have much smaller dimensions, because the opening element no longer represents the element to be operated in order to put the link element under tension.

This enables positioning of the openable clamping element even at the middle longitudinal area of the boot, i.e. at an area where incidental shocks apt to release the device are highly unlikely to be encountered. That possibility results indeed from the closure element having very small dimensions, since,as is known, at the middle longitudinal portion of a boot there is little room available so that heretofore it was impossible to mount conventional levers thereat.

The link element 10 which, as mentioned, has one end pivotally connected to the closure lever 1, is formed, on at least a portion of its surface, with a serration, generally designated with the reference numeral 11. That serration has, in a preferred embodiment thereof, teeth 12 which define a top end in the shape of a semicircle merging with tooth separating grooves, indicated at 13, also configured as a semicircle, obviously with opposite concavity to the tooth.

The link element 10 is provided at its free end with a grip lug, generally indicated at 14.

The openable clamping 20 comprises a small U-shaped base 22 for attachment to the second flap 21; the small base 22 has a pawl element, indicated at 23, mounted between the two sides of the U-shaped base 22 for oscillation about a cross pin 24 constituting a first base means carried on the base sides.

Also provided is an elastic means comprising a pin spring 25 which serves the function of elastically pushing the pawl elements 23 against serration 11.

The pawl element 23 defines, at the lower portion thereof facing the link element 10, a pair of shaped teeth 26 adapted to engage with the teeth of the serration 11.

The teeth 26 are positioned relatively to the pin 24 such as to bring about an increase in the force of engagement with the serration 11, in the event of tension forces on the link element tending to pull the link elements 10 out of the opening element 20 (to the left, in the drawing), while they allow the pawl element 23 to swing up and down as the link element is being inserted into the opening element 20.

The pin spring 25 has two end arms bent over the pawl element 23 and, respectively, one side of the base 22, so as to provide an elastic bias in the direction of engagement of the teeth 26 with the serration 11.

With the pawl element 23 there cooperates a locking lever, indicated at 30, which is pivotally connected to the sides of the small base 22 through a small pin 31 constituting a second hinge means and located substantially above the area affected by the teeth 26, at a point located farther from the surface of the flap 21 than the distance of the cross pin 24 from this same surface.

The locking lever 30 defines a grip extension 32 which extends substantially radially to the small pin 31, and, on the opposed side to the extension 32 with respect to the small pin 31, there extends a locking prong 33 which forms, on the side facing the serration 11, an angle in the 90° to 180° range with the extension 32.

On the outward side, i.e. opposedly to the serration 11, the prong 33 and extension 32 are joined by a bridge portion 34 in the shape of an arc of a circle centered on the axis of the small pin 31 and defining a first cam surface.

The pawl element 23 has, at the portion facing the locking lever 30, a locking recess 40 defining a second cam surface contoured to match the back of the prong 33 defining a second cam surface and located below the ideal line joining the pivot pin 24 to the small pin 31, i.e. on the side facing the link element.

Advantageously, the locking recess 40 is located above the area affected by the teeth 26.

Toward the teeth 26, the locking recess 40 merges in a raised portion 41 defining a third cam follower surface in mating engagement with said second cam surface defined by said prong 33 in an intermediate angular position of said locking lever 32, as visible in FIG. 1, while the other end merges in a seat 42 defining a first cam follower surface whose shape matches the bridge portion 34 in the position shown in FIG. 5. The seat 42 is terminated with a protuberance 43 defining an abutment surface which is engageable, as explained hereinafter, with the back of the grip extension 32.

The opening element 20 allows for unrestricted insertion of the link element 10 by positioning, as shown in FIG. 1, the locking lever 30 such that the prong 33 engages with the raised portion 41.

With this positioning, by inserting the link element 10 into the opening element 20, the engagement of the teeth 26 with the serration 11 allows the pawl element 23 to swing free against the bias of the pin spring 25, until the user has inserted the link element to obtain the desired working length.

Once this positioning has been completed, it will be sufficient to turn the lever 30 (in a clockwise direction as viewed in the drawings) to thereby engage the prong 33 into the locking recess 40.

In this condition, the oscillation in either direction of the pawl element is fully inhibited because of the prong 33 cooperating in firmly fitting the teeth 26 of the pawl element in between selected teeth of the serrations 11 on the link element 10.

Figure 2:
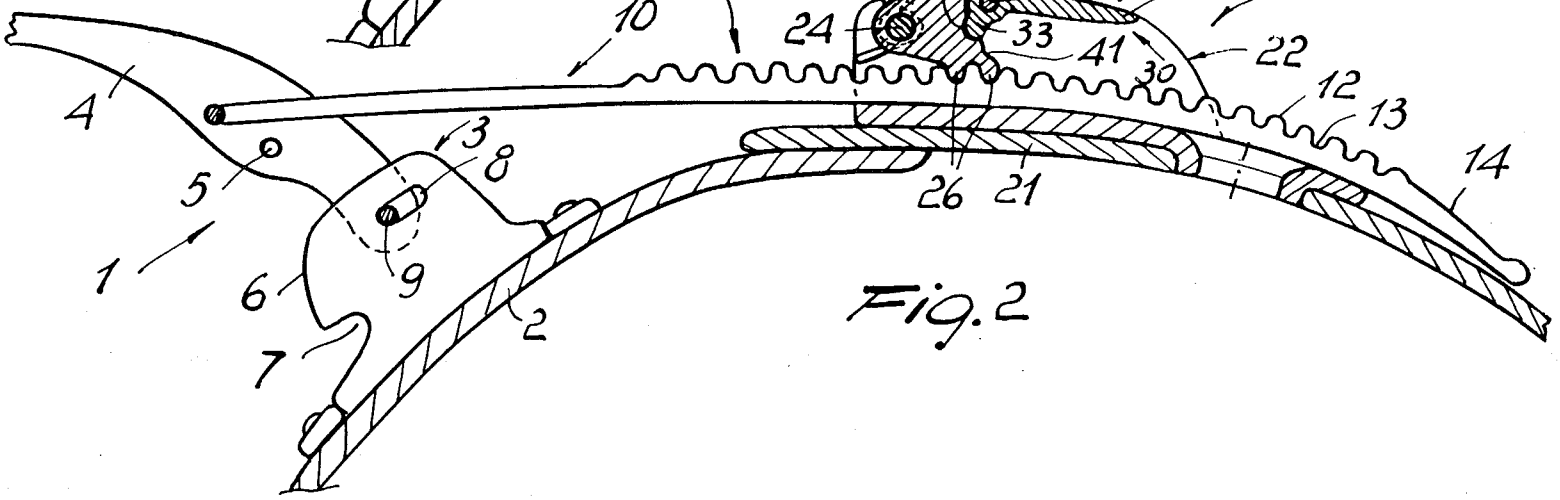
FIG. 2 shows this device with the closure lever in the open position and the link element connected to the opening element.

With this positioning it becomes possible, as shown in FIGS. 2 and 3, to operate the closure lever 1 to close and bring the flaps together as desired.

The closing operation is performed, as previously outlined, by exerting a force on the lever 1, which results in the link element being pulled and the pegs 5 being engaged with the shaped portions 6, until the pegs 5 fit into the recesses 7, whereby the closure lever is held locked and cannot be operated in the opening direction before the pull on the link element 10 is removed.

In order to effect the opening operation of the closure device according to the invention, one should act on the opening element 20 by turning the locking lever 30 (in a counterclockwise direction as viewed in the drawings) such as to first disengage the prong 33 from the locking recess 40, and then engage, by a further rotation in the same direction of the locking lever 30, the protuberance 43 with the back of the grip extension 32 which, owing to its extending radially from the pin 31, generates a component rotates the pawl element 23 against the bias of the pin spring 25, and results in the teeth 26 being disengaged from the serration 11 and the link element 10 being disengaged, so that the pull applied by it is discontinued.

Thus, the closure device just described affords the possibility of closing the flaps 2 and 21 with one lever, which may have much reduced dimensions, and the operating lug whereof will be located, in the closed position, closely against or even set in with respect to the boot surface.

Furthermore, the closure lever is locked in the sense that any operation in the opening direction is prevented owing to the pegs 5 engaging with the recesses 7 provided in the base 3.

A different means is provided to open the closure device, said means comprising the opening element 20, which can be made quite compact because it is merely required to disengage the pawl element 23 from the serration on the link element, without causing translational movements of the link element, but merely discontinuing the clamping action exerted thereon.

It may be appreciated from the foregoing that the invention achieves its objects, and in particular, it should be pointed out that the invention introduces a novel desgin concept in boot closure devices, since a device is provided which includes a part, i.e. the closure lever, which is solely reserved for closing the device, while levers of small size and having operating ends close against the boot may be provided, and another part, formed by the opening element, which has the function of removing the pull on the link element which can be positioned with a settable working length.

The invention as disclosed is susceptible to many modifications and changes without departing from the purview of the instant inventive idea; moreover, all of the details may be replaced with other, technically equivalent, elements.

In practicing the invention, the materials used, as well as the dimensions and contingent shapes, may be any suitable ones.

We claim:

1. A safety closure device for joining together opposite flap portions particularly for ski boots and which comprises fixed on a first flap portion a lever actuated tensioning mechanism including a lever actuated link element and fixed on a second flap portion opposite to said first flap portion an openable clamping mechanism for releasably clamping said link element in a selected position relative to said second flap portion, wherein said lever actuated mechanism comprises, a base member fixed on said first flap portion and having at least one upwardly extending wing formation including a first elongated slot coupling means arranged transversely at a first distance from said first flap portion, said wing formation having a shaped portion facing in a direction away from said openable clamping mechanism, said shaped portion having a recess defining a locking seat opening in said direction away from said openable clamping mechanism and arranged transversely at a second distance from said first flap portion, said second distance being smaller than said first distance, a lever member having a second elongated slot coupling means near one end thereof for cooperation with said first elongated slot coupling means for slidable translatory and rotatory engagement therewith, said first elongated slot coupling means including an elongated slot having a longitudinal extension in a direction towards said openable clamping mechanism thereby to allow said lever member to be displaced with freedom of rotation from a first end position farthest from said openable clamping mechanism to a second end position nearest to said openable clamping mechanism, a peg formation of said lever and spaced apart from said second elongated slot coupling means in a direction away from said openable clamping mechanism, the position and distance of said peg formation relative to said second elongated slot coupling means allowing said peg formation to be engaged within said locking seat when said lever member is shifted towards said openable clamping mechanism under the tensioning action of said link element to thereby reach said second end position and allowing said peg formation to be disengaged from said locking seat when said lever member is shifted away from said openable clamping mechanism thereby reaching said first end position thereof, and hinge means on said lever member spaced apart from said second elongated slot coupling means in a direction away from said openable clamping mechanism for hingedly connecting said link element onto said lever member, thereby to lock said lever member with said peg formation within said locking seat when said link element is under tension and to release said lever member and said peg formation thereof from said locking seat when said link element is slackened.

2. A device according to claim 1, wherein said first elongated slot coupling means comprise said elongated slot on said wing formation and said second elongated slot coupling means comprise a pivot pin on said lever member and slidably and rotatorily engageable within said elongated slot.

3. A safety closure device for joining together opposite flap portions particularly for ski boots and which comprise fixed on a first flap portion a lever actuated tensioning mechanism including a lever actuated link element and fixed on a second flap portion opposite to said first flap portion an openable clamping mechanism for releasably clamping said link element in a selected position relative to said second flap portion, said lever actuated link element being in the form of a strap member having a serration on at least a part thereof and wherein said openable clamping mechanism comprises, a base member fixed on said second flap portion, said base member having first hinge means transversely at a first distance from said second flap portion and second hinge means spaced apart from said first hinge means and transversely at a second distance from said second flap portion, a pawl member hinged on said base member through said first hinge means, said pawl member having a first side thereof facing towards said second flap portion and having a tooth formation thereon for engagement with said serration, said tooth formation being arranged at a location more distant from said lever actuated tensioning mechanism than said first hinge means from said lever actuated tensioning mechanism.

said pawl member having a second side thereof facing away from said lever actuated tensioning mechanism and extending transverse to said first side and transverse to said second flap portion and a composite cam follower surface on said second side thereof, a locking lever hinged on said base member through said second hinge means and having a hinged end thereof cooperating with said second hinge means and defining a composite cam surface at least partially in slidable mating engagement with said composite cam follower surface, said composite cam surface defining a prong formation located below both said first and said second hinge means and said composite cam follower surface defining a recess formation countoured to match said prong formation and located above said tooth formation, thereby causing said pawl member upon actuation of said locking lever to be rotated into a first end position out of engagement of said tooth fromation thereof with said serration when said locking lever is rotated into an opening position thereof and said composite cam surface and said composite cam follower surface causing said pawl member to be rotated into a second end position thereof in engagement of said tooth formation thereof with said serration when said locking lever is rotated into a clamping position thereof upon adjustment of the position of said strap member relative to said openable clamping mechanism, and wherein said lever actuated mechanism comprises, a base member fixed on said first flap portion and having at least one upwardly extending wing formation including a first elongated slot coupling means arranged transversely at a first distance from said first flap portion, said wing formation having a shaped portion facing in a direction away from said openable clamping mechanism, said shaped portion having a recess defining a locking seat opening in said direction away from said openable clamping mechanism and arranged transversely at a second distance from said first flap portion, said second distance being smaller than said first distance, a lever member having a second elongated slot coupling means near one end thereof for cooperation with said first elongated slot coupling means for slidable translatory and rotatory engagement therewith, said first elongated slot coupling means including an elongated slot having a longitudinal extension in a direction towards said openable clamping mechanism thereby to allow said lever member to be displaced with freedom of rotation from a first end position farthest from said openable clamping mechanism to a second end position nearest to said openable clamping mechanism, a peg formation on said lever and spaced apart from said second elongated slot coupling means in a direction away from said openable clamping mechanism, the position and distance of said peg formation relative to said second elongated slot coupling means allowing said peg formation to be engaged within said locking seat when said lever member is shifted towards said openable clamping mechanism under the tensioning action of said link element to thereby reach said second end position and allowing said peg formation to be disengaged from said locking seat when said lever member is shifted away from said openable clamping mechanism thereby reaching said first end position thereof, and hinge means on said lever member spaced apart from said elongated slot coupling means in a direction away from said openable clamping mechanism for hingedly connecting said link element onto said lever member, thereby to lock said lever member with said peg formation within said locking seat when said link element is under tension and to release said lever member and said peg formation thereof from said locking seat when said link element is slackened.

* * * * *